US009965915B2

(12) United States Patent
Guajardo Merchan et al.

(10) Patent No.: US 9,965,915 B2
(45) Date of Patent: May 8, 2018

(54) SYSTEM AND METHOD FOR DOCUMENT AND ARTICLE AUTHENTICATION

(71) Applicant: Robert Bosch GmbH, Stuttgart (DE)

(72) Inventors: Jorge Guajardo Merchan, Pittsburgh, PA (US); Charu Hans, Houston, TX (US)

(73) Assignee: Robert Bosch GmbH, Stuttgart (DE)

( * ) Notice: Subject to any disclaimer, the term of this patent is extended or adjusted under 35 U.S.C. 154(b) by 121 days.

(21) Appl. No.: 15/022,584

(22) PCT Filed: Sep. 23, 2014

(86) PCT No.: PCT/US2014/056883

§ 371 (c)(1),
(2) Date: Mar. 17, 2016

(87) PCT Pub. No.: WO2015/047977

PCT Pub. Date: Apr. 2, 2015

(65) Prior Publication Data

US 2016/0232734 A1 Aug. 11, 2016

Related U.S. Application Data

(60) Provisional application No. 61/881,809, filed on Sep. 24, 2013.

(51) Int. Cl.
*G07D 7/20* (2016.01)
*G07D 7/004* (2016.01)
(Continued)

(52) U.S. Cl.
CPC ..... *G07D 7/2016* (2013.01); *G07D 7/004* (2013.01); *G07D 7/0043* (2017.05); *G07D 7/12* (2013.01);
(Continued)

(58) Field of Classification Search
CPC ... G07D 7/2016; G07D 7/2041; G07D 7/2043
See application file for complete search history.

(56) References Cited

U.S. PATENT DOCUMENTS 6,522,441 B1 * 2/2003 Rudeen ..... G02B 26/105 235/462.23
8,534,544 B1 9/2013 Eker et al.
(Continued)

FOREIGN PATENT DOCUMENTS

WO 2006120643 A1 11/2006

OTHER PUBLICATIONS

International Search Report corresponding to PCT Application No. PCT/US2014/056883, dated Dec. 5, 2014 (4 pages).
(Continued)

*Primary Examiner* — Ellen Tran
(74) *Attorney, Agent, or Firm* — Maginot, Moore & Beck LLP

(57) ABSTRACT

A system for authentication of paper sheet and other articles includes an optical sensor configured to generate an image of a first side of an article and a processor operatively connected to the optical sensor. The processor is configured to generate an image of the article with the optical sensor, the image including features that are illuminated by an external illumination source through the article, and generate an output indicating if the article is authentic in response to the features corresponding to a predetermined plurality of features that are generated from another image of the article corresponding to features in the generated image and in response to a cryptographic signature corresponding to feature data that are extracted from the other image corresponding to a valid cryptographic signature of a predetermined party.

17 Claims, 6 Drawing Sheets

(51) Int. Cl.

| | |
|---|---|
| ***G07D 7/12*** | (2016.01) |
| ***G07D 7/2033*** | (2016.01) |
| ***G07D 7/202*** | (2016.01) |
| ***G07D 7/0043*** | (2016.01) |

(52) U.S. Cl.
CPC ..... *G07D 7/2033* (2013.01); *G07D 7/2041* (2013.01)

(56) References Cited

U.S. PATENT DOCUMENTS

| | | | | |
|---|---|---|---|---|
| 2003/0047612 | A1* | 3/2003 | Shaked | G06K 7/14 235/462.1 |
| 2005/0038756 | A1* | 2/2005 | Nagel | G06K 19/086 705/76 |
| 2010/0027851 | A1* | 2/2010 | Walther | G06K 5/00 382/112 |
| 2013/0046698 | A1* | 2/2013 | Gagerman | G06Q 20/042 705/71 |

OTHER PUBLICATIONS

Haist, et al., Optical Detection of Random Features for High Security Applications, Optics Communications, Feb. 1, 1998, pp. 173-179, vol. 147, issue Nos. 1-3, North-Holland Publishing Co., Amsterdam, NL.

* cited by examiner

SYSTEM AND METHOD FOR DOCUMENT AND ARTICLE AUTHENTICATION

CLAIM OF PRIORITY

This application is a 35 U.S.C. § 371 National Stage Application of PCT/US2014/056883, filed on Sep. 23, 2014, which claims the benefit of priority to U.S. Provisional Application No. 61/881,809, filed on Sep. 24, 2013 and entitled "System and Method for Document and Article Authentication," the disclosures of which are incorporated herein by reference in their entireties.

TECHNICAL FIELD

This disclosure relates generally to the fields of image analysis and data security, and, more particularly, to systems and methods for authentication of articles including documents formed on paper and other articles.

BACKGROUND

Authentication of printed papers other articles ensures that a document that purports to be an original document is in fact the original document. For years, a handwritten signature has been one method that human use to authenticate a paper document for authentication by other humans and, more recently, by machines. Handwritten signatures, however, can be forged, may be difficult to authenticate even if they are not forged, and require the manual action of a human signatory who may be unable to sign a large number of individual sheets in a document to ensure authenticity.

In the fields of image processing and cryptography, some techniques for authenticating paper documents rely on detailed scans of printed text or graphics that are formed on the paper or on detailed scans of the structure of the paper. Many existing techniques rely on the identification of random properties of printed marks, including authentication marks that are specifically printed for the purpose of authenticating a piece of paper in a document. Still other techniques rely on high-resolution scanning devices to identify unique and non-cloneable properties of each sheet of paper, such as a pattern of wood fibers in the paper, to authenticate the sheet of paper.

As described above, existing authentication systems often require the production of specific authentication marks or the use of high-resolution scanning equipment that is often unavailable to either the party who produces the document or the party who authenticates the document. Consequently, improvements to systems and methods for authentication of documents and other articles that simplify the process of authenticating and verifying the authenticity of the article would be beneficial.

SUMMARY

In one embodiment, a system for authentication of an article has been developed. The system includes an optical sensor configured to generate an image of the article and a processor operatively connected to the optical sensor. The processor is configured to generate an image of the article with the optical sensor, the article being illuminated by an external illumination source that projects light through the article, identify a region of interest in the image of the article including a non-cloneable feature, generate a first feature vector corresponding to the non-cloneable feature in the region of interest in the image of the article, receive data corresponding to a second feature vector and a cryptographic signature generated by a sending party, generate a distance measurement between the first feature vector and the second feature vector, verify that the cryptographic signature corresponds to the second feature vector, and generate an output indicating that the article is authentic in response to the distance measurement being less than a predetermined threshold and to verification that the cryptographic signature corresponds to the second feature vector.

In another embodiment, a system for authentication of an article has been developed. The system includes an optical sensor configured to generate an image of the article, a printer configured to form a printed barcode on the article, and a processor operatively connected to the optical sensor and the printer. The processor is configured to generate an image of the article with the optical sensor, the article being illuminated by an external illumination source that projects light through the article, identify a region of interest in the image of the article including a non-cloneable feature, generate a feature vector corresponding to the non-cloneable feature in the region of interest in the image of the article, generate a cryptographic signature of data corresponding to the feature vector, and print a barcode on the article with the printer, the barcode including an encoded representation of the data corresponding to the feature vector and the cryptographic signature.

DETAILED DESCRIPTION

For the purposes of promoting an understanding of the principles of the embodiments described herein, reference is now be made to the drawings and descriptions in the following written specification. No limitation to the scope of the subject matter is intended by the references. This patent also includes any alterations and modifications to the illustrated embodiments and includes further applications of the principles of the described embodiments as would normally occur to one skilled in the art to which this document pertains.

As used herein, the term "non-cloneable feature" refers to a physical property of an article that cannot be replicated in a practical manner. For example, many types of paper are formed from an arrangement of fibers from wood or other fibrous materials. The arrangement of fibers between different sheets of paper has random properties that a forger cannot reproduce in a practical manner. Other non-cloneable features in different articles include variations in the surface texture of some articles.

As used herein, the term "barcode" refers to any printed or engraved indicia formed on an article that encode information. Common examples of barcodes include one-dimensional and two-dimensional barcodes. Barcode readers that are known to the art decode the information in barcodes using digital images or optical scans of the barcodes. As described in more detail below, a printed barcode encodes information corresponding to feature vectors that describe non-cloneable features in an article. The barcodes also encode cryptographic signatures of the feature vector data from a sending party that a receiving party uses to verify the authenticity of an article.

Figure 1:
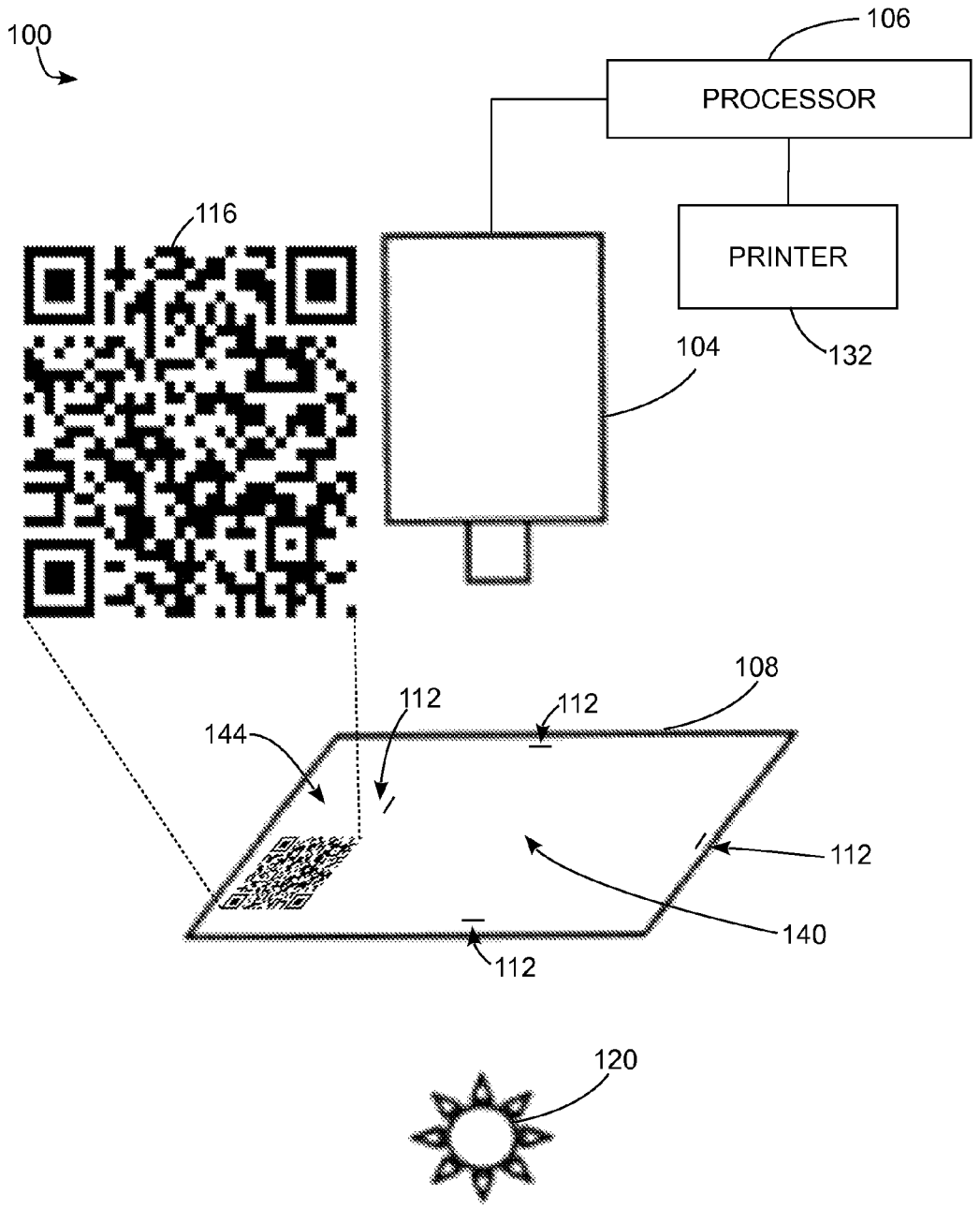
FIG. 1 is a diagram of a system for generating a photograph of a sheet of paper to generate a cryptographic signature corresponding to features in the paper or to validate that a cryptographic signature corresponds to features in the paper during an authentication process.

FIG. 1 depicts a system 100 that is configured to generate a cryptographic signature corresponding to features that are identified in an article, such as a sheet of paper, and to verify an existing cryptographic signature for the article during an authentication process. The system 100 includes an optical sensor 104, digital processor 106, external illumination source 120, and an optional printer 132. In the embodiment of FIG. 1, the optical sensor 104 is a digital camera such as a camera that incorporates a charge-coupled device (CCD) or complementary metal oxide (CMOS) image sensor. In addition to digital cameras, the optical sensor 104 can be embodied as any imaging device that generates digital image data of the article and the non-cloneable features that are present in the article. The processor 106 is a digital microprocessor, digital signal processor (DSP), or any other digital processing devices that is configured to execute stored program instructions to perform the processing described below for the generation and validation of digital signatures. The processor 106 further incorporates memory devices that store programmed instruction data, image and feature vector data generated from the optical sensor 104, and cryptographic keys that are used to generate and verify signatures based on the non-cloneable features in an image of an article.

In one embodiment, the optical sensor 104 and processor 106 are contained in a mobile electronic device such as a smartphone, tablet computing device, wearable computing device, or personal computer (PC). The processor 106 is also operatively connected to one or more input/output devices (not shown) to enable generation of the signature for a sheet of paper and to confirm or deny the validity of a signature for the sheet of paper. In the embodiment of FIG. 1 the external illumination source 120 is a standard light bulb including, but not limited to, incandescent, fluorescent, and light emitting diode (LED) light that emit a broad spectrum of light colors. In the embodiment of FIG. 1, the external illumination source 120 is a non-coherent light source. That is to say, the external illumination source 120 does not produce light waves that have fixed frequencies and constant phase differences. As described above, sunlight and light from standard incandescent, fluorescent, and LED lights are examples of non-coherent light sources. Alternative embodiments of the external illumination source 120 include monochromatic light sources, infrared light sources, and coherent light sources such as LASER light emitters. During operation, the external illumination source 120 emits light that projects through the thickness of the sheet 108 to illuminate features within the sheet 108. The optical sensor 104 produces digital images of the sheet 108, including the illuminated features, the registration marks 112 and a printed barcode 116.

In FIG. 1, the sheet of sheet 108 includes registration marks 112 that are printed on the sheet. The optical sensor 104 generates pictures of the sheet 108 including the registration marks 112 to enable the processor 106 to orient the images of the sheet 108 even when the optical sensor 104 takes pictures of the sheet 108 from different positions and angles. In the embodiment, of FIG. 1, the sheet 108 includes the optional printed barcode 116 or other encoding mark that includes an encoded copy of the feature vector for features in the image of the sheet of paper, optional error correction data, and a digital signature of the feature vector and error correction information from the signing party that recipient uses to validate the authenticity of the sheet 108. The barcode 116 is printed on the sheet 108 after the system 100 generates the feature vector. A receiving party decodes the data in the printed barcode 116 to verify the authenticity of the sheet using the data that are encoded in the barcode 116.

The system 100 or similar embodiments are used during an authentication process by both the sending party and the receiving party that verifies the authenticity of the article. In some instances, the sending party uses one instance of the system 100 to generate authentication data for the article and the receiving party uses a different instance of the system 100 to verify the authenticity of the article.

During a first stage of an authentication process, the sending party uses the system 100 to identify non-cloneable features in the article 108 and to generate a cryptographic signature of a feature vector or hashed value corresponding to the non-cloneable features. As described in more detail below, the system 100 generates digital photographic image data of a region of interest 140 in the article 108 and the processor 106 generates feature vectors or other suitable identification data of the non-cloneable features. The system 100 generates a digital signature of the non-cloneable feature data and in the embodiment of FIG. 1 the processor 106 operates the printer 132 to form a printed barcode 116 on a margin 144 of the article 108. The printed barcode 116 includes the digital signature corresponding to the non-cloneable features in the article 108.

During a second stage of the authentication process, a receiving party uses the optical sensor 104 and processor 106, or alternative embodiments thereof, to generate another image of the article 108, generate the corresponding feature vectors based on the non-cloneable features of the article 108, and verify that the signature data in the barcode 116 corresponds to the non-cloneable features in the article 108 to authenticate the article 108 as the same article that was signed by the sending party.

In the system 100, the external illumination source 120 illuminates patterns of fibers and material textures in the sheet 108 that are non-cloneable features. The optical sensor 104 generates digital image data of the illuminated features in the sheet 108, and the processor 106 performs image processing functions to generate a feature vector that corresponds to features in the original image data. During a signing process, an authenticating party uses a cryptographic private key to sign the feature vector. During a verification process, a recipient of the sheet 108 regenerates the feature vector or a similar feature vector from images of the sheet 108 and verifies the authenticity of the feature vector using the digital signature and a public key that is associated with the signing party. In alternative embodiments, the feature vector, error correction data, and the digital signature are encoded and transmitted to the recipient in a different medium and the sheet 108 does not require the barcode 116.

Figure 2:
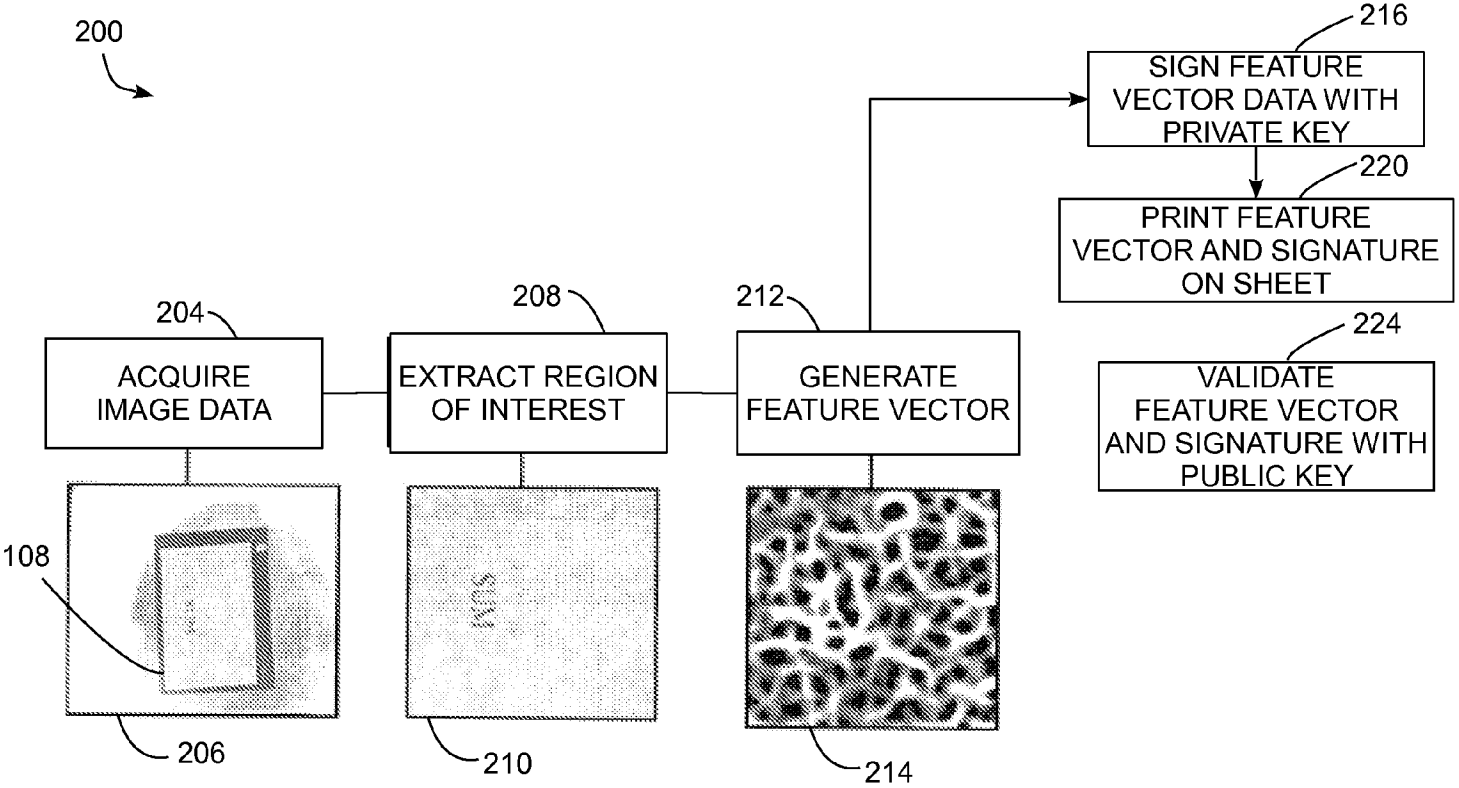
FIG. 2 is a flow diagram of a process for producing an image of features in a sheet of paper and for generation of a cryptographic signature for the sheet of paper by a signing party and for validation of the features and the cryptographic signature by a validating party.

FIG. 2 depicts a process 200 for signing and verifying a signature to authenticate a sheet of paper or another article that has a textured surface and is translucent to light. Examples of such articles include plastic and wood-pulp or fiber-pulp based packages or tags. The textured material provides non-cloneable features that are unique to the article and that can be recorded in an image. The translucent property of the article refers to a property of the article to enable some light to pass through the article to illuminate the textured features for reproduction in an image. In the illustrative embodiment of FIG. 2, the process 200 is used with a sheet of paper as the article that a signing party authenticates and that a receiving party verifies. In the description below, a reference to the process 200 performing a function or action refers to the execution of stored program instructions by a processor to perform the function or action in conjunction with one or more components, such as an optical sensor or input/output device. The process 200 is described in conjunction with the system 100 of FIG. 1 for illustrative purposes.

Process 200 begins with acquisition of an image of the paper sheet with the optical sensor (block 204). In the system 100, the illumination source 120 provides a backlight to the paper sheet 108 to enable the optical sensor 104 to generate an image that includes the illuminated fibers and other features in the paper sheet 108. In an alternative embodiment, an external light source or sunlight can illuminate the translucent paper or another translucent article. The image also includes the registration marks 112 to enable the processor 106 to orient multiple images of the sheet 108 in a uniform manner when the optical sensor 104 generates images of the sheet 108 from different angles and distances. In FIG. 2, the optical sensor 104 generates the initial image 206 that includes the paper sheet 108 and a region surrounding the sheet 108.

Figure 3:
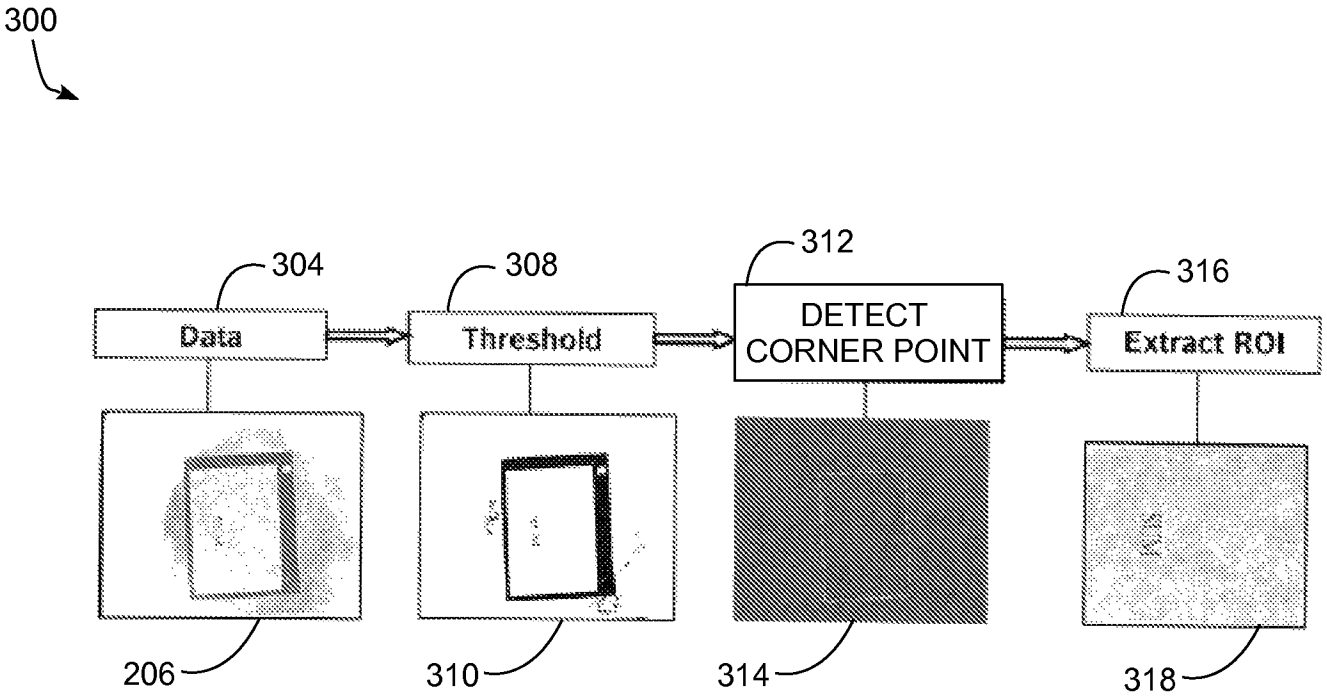
FIG. 3 is a flow diagram of a process for extracting a region of interest from a photograph of a sheet of paper in conjunction with the process of FIG. 2.

Process 200 continues as the system 100 extracts a region of interest in the sheet from the generated image (block 208). In FIG. 2, the image 210 depicts a region of the media sheet 108 that is selected as a region of interest from the image 206 for the identification of features in the sheet 108. FIG. 3 depicts one embodiment of a region of interest extraction process 300 that is performed during the process 200 in more detail. During process 300, the processor 106 receives the captured image data 206 from the optical sensor 104 (block 304). The processor 106 performs a thresholding operation to reduce the effects of random noise in the image data for identification of the edges of the media sheet and the locations of the registration marks on the media sheet (block 308). In FIG. 3, the image 310 depicts a modified version of the image 206 after the thresholding process. The processor 106 identifies corner points of the media sheet in the thresholded image (block 312). The corner points correspond to corner coordinates of the sheet that enable the processor 106 to model the sheet as a polygon in the image data to identify different regions on the surface of the sheet. In one embodiment, the processor 106 uses an edge detection algorithm in the thresholded image data to identify the edges and corners of the sheet as depicted in the image 314.

After identifying the corners of the sheet, the processor 106 extracts predetermined regions that are within the sheet to use in identifying features within the sheet (block 316). In the embodiment of FIG. 1, the processor 106 identifies the printed registration marks 112 in the image data of the sheet 108. The region of interest 140 on the sheet 108 lies within the registration marks 112. Other regions of the sheet 108 that lie outside of the region of interest include a margin 144 that contains the two-dimensional printed barcode 116. In the illustrative embodiment of FIG. 1, the region of interest 140 includes all or most of the area of the sheet 108 that carries printed information. FIG. 3 depicts a set of image data 318 that corresponds to the region of interest 140 on the sheet 108.

Figure 6:
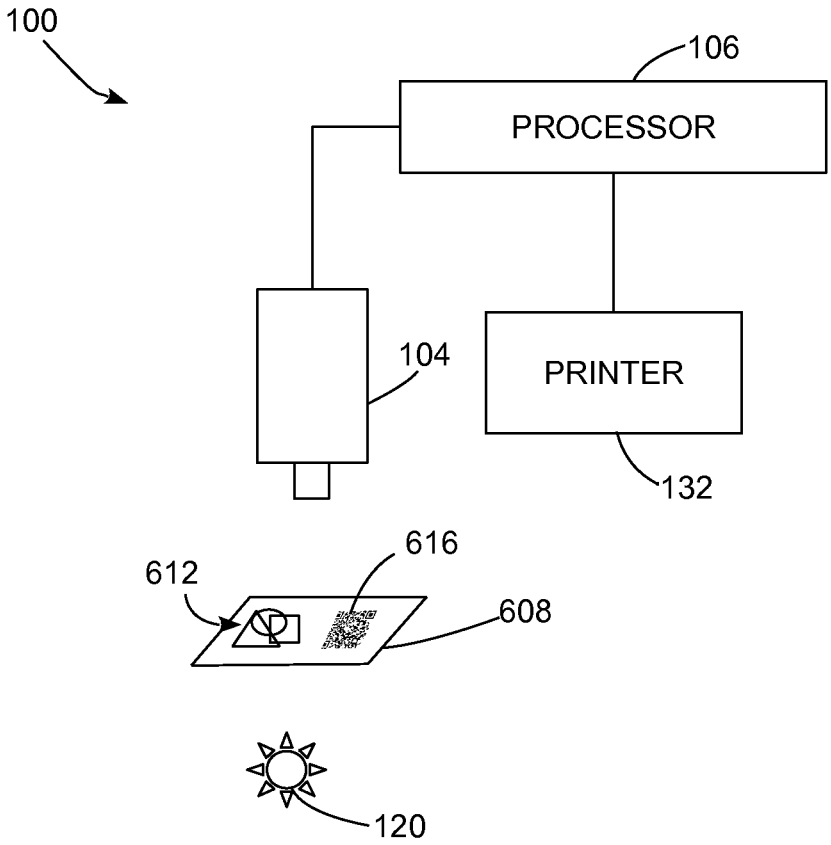
FIG. 6 is a depiction of an article that includes a region of interest formed from a printed logo.

In other embodiments, the article includes a printed logo or other predetermined mark that defines the area of interest. FIG. 6 depicts an illustrative embodiment of a tag 608 that includes a region of interest formed by a printed logo 612. The tag 608 is formed from a translucent paper or plastic material, and also includes a printed barcode 616 that includes a cryptographically signed set of feature vector data or hash data corresponding to the non-cloneable features in area of interest 612 of the tag 608. The optical sensor 104 and the processor 106 perform the processes 200 and 300 to authenticate the validity of the tag 608 in a similar manner to the authentication of the printed sheet 108. In some embodiments, the tag 608 is affixed to another item and can be used to verify the authenticity of the item. The tag 608 can be produced using techniques that are known to the art to be a tamper-evident tag that cannot be removed from the article without showing visible signs of tampering. Thus, the tag 608 can be used to verify the authenticity of larger articles that the sender ships to the receiver.

The process 300 enables identification of the region of interest and orientation of the region of interest of an article when one or more optical sensors produce images of the article. In alternative embodiments, the region of interest is identified with reference to an overall shape of the article or the article is placed in a predetermined distance and alignment with multiple optical sensors to enable a simple identification of the region of interest as a predetermined region in multiple photographs of the same article. While the processing to identify the regions of interest in the original image 206 uses thresholding and edge detection processes that filter the image data to reduce noise, after identifying the regions of interest the processor 106 uses the corresponding sections of the original image data that depict the fibers and other features within the sheet 108 with greater detail.

Referring again to FIG. 2, process 200 continues as the processor 106 generates a feature vector corresponding to the image data in the selected region of interest (block 212). In one embodiment, the feature vector is a fixed-length set of binary data that is encoded based on the pixels in the image data that depict fibers and other random elements in the sheet 108 that cannot be replicated in a practical manner in another sheet of paper. Non-cloneable features of interest in a sheet of paper or other translucent article include features that are perceptible in photographic images of the article in question, such as digital photographic images of paper or other translucent articles when an external illumination source 120 projects light through the article. The image 214 depicts an example of a random arrangement of fibers in a sheet of paper that are included in the region of interest for the image. While different images of the same sheet of paper are similar but not perfectly identical, the feature vector is encoded in a manner that enables regeneration of similar feature vectors with tolerance for the variations that occur between multiple images of the same sheet of paper, while still enabling the processor 106 to distinguish between two different sheets of paper that have different features. In some embodiments, the processor 106 generates additional error correction code (ECC) data that enable reconstruction of the original feature vector from similar image data. In alternative embodiments, other feature extractors including fuzzy extractors that are known to the art can be used for generation of the feature vectors. Fuzzy extractors can produce feature vectors that are inherently robust to errors that are expected to be produced between multiple images of the same article.

In one configuration, the process 200 generates a digital signature of the feature vector (block 216). Using a public key infrastructure (PKI) system that is well known to the art, the signing party uses a secret key that is known only to the signing party in conjunction with a signature algorithm to generate a cryptographically secure signature of the feature vector and any other data, such as ECC data, that are required to validate the authenticity of the paper. Due to the nature of PKI cryptographic systems, the signature can be distributed freely without compromising the integrity of the private signing key. In one embodiment of the process 200, the digital signature, feature vector, and any other data that are required to validate the authenticity of the document are printed on the sheet in the form of a barcode or other encoded marking that can be easily read and interpreted by another computing device (block 220). The barcode is typically printed on a margin area of the sheet that is outside the region containing the features that form the basis of the feature vector.

As depicted in FIG. 1, a two-dimensional barcode 116 is printed in the margin area 144 of the sheet 108 that is outside of the region of interest 140. During process 200, the sending party uses a laser printer, inkjet printer, or other suitable marking device 132 forms the two-dimensional barcode 116 in the margin 144 of the sheet 108. In some embodiments, the printer 132 also prints the registration marks 112 on the sheet 108. For articles that are not compatible with standard printers, the printer 132 is an engraving device that engraves a visible pattern that corresponds to the barcode 116. The receiving party does not require the printer 132 for authentication of the sheet 108. In an alternative embodiment, the feature vector data and signature for the feature vector are sent to a recipient of the sheet using another communication mechanism. Further, while a PKI infrastructure is one method to verify that the signing party actually generated the feature vector for the sheet for authentication of the sheet, other authenticated communication channels between the sending party and the receiving party could be used to communicate the feature vector data in a manner that the receiving party trusts. For example, a communication channel between the signing party and the recipient that is established using a shared secret key cryptographic system could be used to send the feature vector data in a trusted manner. In another embodiment, a message authentication code (MAC) is transmitted between the signing party and the receiver. The MAC is used in embodiments where the signing party and the receiving party each have trusted devices that store a shared secret key and use the shared secret key for signing and verifying the encoded data.

During process 200, the sending party performs the processing of blocks 204-220 to identify the non-cloneable features in image data of an article, generate a cryptographic signature of feature vector data corresponding to the non-cloneable features, and send the cryptographic signature to a recipient, such as through printing the signature as a barcode on the article in the illustrative embodiment of FIG. 1. During process 200, the recipient performs an authentication process for the article using the processing described above in blocks 204-212 to generate the feature vector data of the non-cloneable features from an image of the article. The recipient also authenticates the article using a verification process to ensure that the cryptographic signature from the sending party corresponds to the feature vector data from the non-cloneable features in the article (block 224). The recipient uses the optical sensor 104 and processor 106, or alternative embodiments thereof, to regenerate the feature vector data based on the non-cloneable features of the article. The recipient authenticates the article based on a cryptographic signature from the sending party.

In the embodiment of FIG. 1, the recipient uses the optical sensor 104 and processor 106 to authenticate the sheet 108 based on the feature vectors in the non-cloneable features of the sheet 108 and the signature information that is encoded in the printed barcode 116. The recipient also generates image data of the barcode 116 and decodes the barcode 116 using techniques that are known to the art to retrieve the feature vector data, optional MAC and ECC data, and signature from the sending party. In the embodiment of FIG. 1, the recipient uses the system 100 to retrieve a feature vector that is identical or similar to the feature vector that the signing party encodes in the barcode 116. The recipient uses the public key that is associated with the signing party in conjunction with the signature that is included in the barcode 116 to verify that the signing party was responsible for producing the encoded feature vector instead of a malicious third party.

Figure 4:
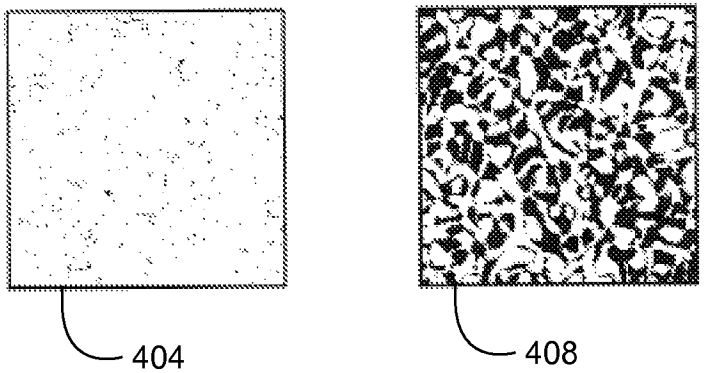
FIG. 4 is an illustration of difference images corresponding to two images that are generated from a single sheet of paper and two images that are generated from two different sheets of paper.

During the authentication process, the recipient compares a feature vector for the printed sheet to the previously encoded feature vector from the sending party. FIG. 4 depicts two difference images that are generated from two images of a single sheet of paper, and two images from two different sheets of paper. The image 404 depicts differences between the two images of a single region of the same sheet of paper. The dark areas indicate where the two images differ, while the white areas indicate where the two images are the same. As seen in FIG. 4, there are some dark areas in the image 404, but the large majority of the image 404 is white, which indicates a high degree of commonality between the two images. In FIG. 4, the difference image 408 is generated from two images of different sheets of paper. In the difference image 408, the proportion of black areas indicating differences between the two images is much greater than in the image 404. The corresponding feature vectors between the two images of the two different sheets of paper are also much greater than the corresponding feature vectors that are generated for two images from the same sheet of paper.

Figure 5:
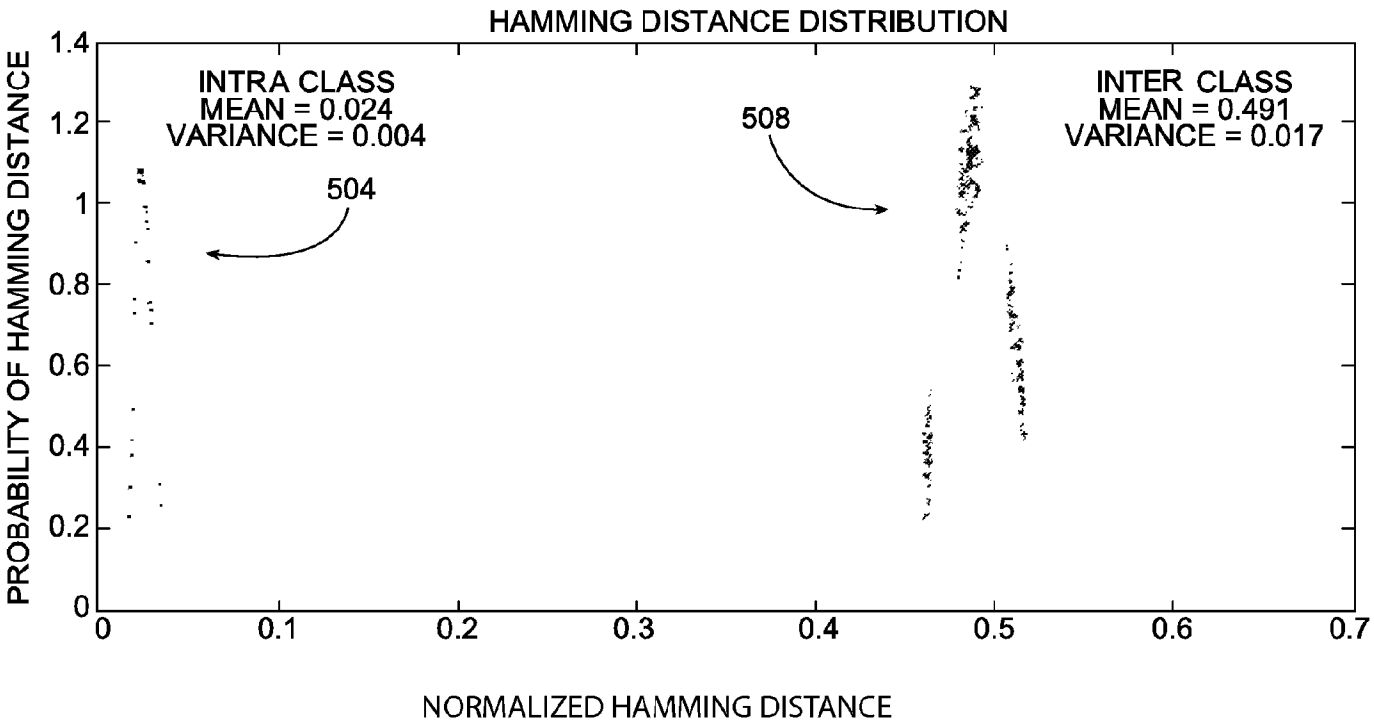
FIG. 5 is a graph depicting a distribution of Hamming distance measurements between feature vectors that are generated from multiple images of a single sheet of paper and feature vectors that are generated from multiple images of different sheets of paper.

The recipient can compare the feature vectors using techniques that are known to the art such as Hamming distance measurements. In alternative embodiments, the distance is determined as a Euclidean distance, Minkowski distance, a distance correlation, Pearson coefficient, or other suitable measurement of distance between two feature vectors. As depicted in FIG. 5, the Hamming distance measurements for feature vectors that are generated from multiple images of the same sheet (region 504) are substantially lower than the Hamming distance measurements between feature vectors that are produced from images of different paper sheets (region 508). Thus, while the feature vector from the signing party may not be identical to the feature vector that the recipient produces, the recipient can determine if the two feature vectors are similar enough to be generated from a single sheet of paper or if the feature vectors correspond to two different sheets of paper. Table 1 lists additional statistical information about the Hamming distances that are depicted in FIG. 5.

TABLE 1

Mean and Variance of Inter Class and Intra Class Hamming Distance Distributions

| | Mean | variance |
|---|---|---|
| Inter class (images of two different sheets) | 0.02 | 0.004 |
| Intra class (two images of a single sheet) | 0.491 | 0.017 |

In an alternative embodiment, the sending party does not reproduce the signed feature vector in a 2D barcode or other encoded manner for transmission to the receiver. Instead, the sender only generates a signed hash or other authentication code corresponding to the feature vector the encoded error correction code (ECC) data and a signature for the ECC data. The receiving party then independently reconstructs the feature vector, which may have some errors compared to the original feature vector that the sending party produced during the signature process. The receiving party verifies that the ECC data are authentic using the public key or shared secret key from the sending party. The receiving party applies the ECC data to the feature vector to generate a reconstructed feature vector that matches the original feature vector from the sending party if the two feature vectors are similar enough for the ECC data to correct any remaining differences between the two feature vectors. If the hash of the regenerated feature vector matches the signed hash from the sending party, then the receiving party verifies the authenticity of the article. In one embodiment, the sending party encodes only the hash and the ECC data to reduce the size of data that are sent to the receiving party for verification. The ECC data enable the receiving party to re-generate the exact value of the signed hash even if the receiving party generates a feature vector that is somewhat different from the original feature vector from the sending party. The reduced data size may be more compatible with relatively low-density data encoding formats such as printed barcodes.

In an alternative embodiment to the processes 200 and 300, the system 100 produces a signed copy of the photograph of the paper sheet or other article including the features, but without specific generation of a feature vector. The signing party sends the entire signed photograph to the receiving party, typically through a data network such as the Internet. The receiving party receives both the signed photograph of the article, and the physical article. The receiving party then produces another photograph of the physical article and identifies if the photograph corresponds to the signed photograph from the signing party. In an embodiment where the signer transmits the entire photograph to the receiver, the digital data corresponding to the entire photograph is also the feature vector for the photograph where the feature vector includes every pixel from the original photograph. The signing party optionally includes ECC data with the image and signs the transmitted data with a private key in a PKI embodiment or with a MAC in a shared-secrete key embodiment.

It will be appreciated that variants of the above-described and other features and functions, or alternatives thereof, may be desirably combined into many other different systems, applications or methods. Various presently unforeseen or unanticipated alternatives, modifications, variations or improvements may be subsequently made by those skilled in the art that are also intended to be encompassed by the following claims.

What is claimed:

1. A system for authentication of a translucent article comprising:

an optical sensor configured to generate an image of the article; and a processor operatively connected to the optical sensor, the processor being configured to:

generate an image of the article with the optical sensor, the article being illuminated by an external illumination source that projects light through the article from an opposite side of the article from the optical sensor as the image is generated;

identify a region of interest in the image of the article including a non-cloneable feature, the non-cloneable feature being formed by at least one of fibers and material textures in the article depicted in the region of interest of the image;

generate a first feature vector corresponding to the non-cloneable feature in the region of interest in the image of the article;

receive data corresponding to a second feature vector and a cryptographic signature generated by a sending party;

generate a distance measurement between the first feature vector and the second feature vector;

verify that the cryptographic signature corresponds to the second feature vector; and generate an output indicating that the article is authentic in response to the distance measurement being less than a predetermined threshold and to verification that the cryptographic signature corresponds to the second feature vector.

2. The system of claim 1, the processor being further configured to:

operate the optical sensor to generate another image of a printed barcode on the article; and decode the printed barcode to receive the data corresponding to the second feature vector and the cryptographic signature.

3. The system of claim 1, the processor being further configured to:

identify a printed barcode in the image of the article; and decode the printed barcode to receive the data corresponding to the second feature vector and the cryptographic signature.

4. The system of claim 3, the processor being further configured to:

identify at least one registration mark in the image of the article; and identify the region of interest in the image of the article with reference to the at least one registration mark.

5. The system of claim 4, the processor being further configured to:

identify the printed barcode in the image of the article outside of the region of interest.

6. The system of claim 1, the processor being further configured to:

receive the data corresponding to the second feature vector including a hash of the second feature vector and error correction code (ECC) data from the second feature vector;

generate a reconstructed feature vector with reference to the first feature vector and the ECC data;

generate a hash of the reconstructed feature vector; and generate the output indicating that the article is authentic in response to the hash of the second feature vector matching the hash of the reconstructed feature vector.

7. The system of claim 1, the processor being further configured to:

generate the distance measurement with a Hamming distance measurement between the first feature vector and the second feature vector.

8. The system of claim 1, the processor being further configured to:

verify that the cryptographic signature corresponds to the second feature vector with reference to a predetermined public key corresponding to a private key used to generate the cryptographic signature.

9. The system of claim 1 wherein the article is a sheet of paper.

10. The system of claim 1 wherein the external illumination source is a non-coherent light source.

11. A system for authentication of a translucent article comprising:

an optical sensor configured to generate an image of the article;

a printer configured to form a printed barcode on the article; and a processor operatively connected to the optical sensor and the printer, the processor being configured to:

generate an image of the article with the optical sensor, the article being illuminated by an external illumination source that projects light through the article from an opposite side of the article from the optical sensor;

identify a region of interest in the image of the article including a non-cloneable feature, the non-cloneable feature being formed by at least one of fibers and material textures in the article depicted in the region of interest of the image;

generate a feature vector corresponding to the non-cloneable feature in the region of interest in the image of the article;

generate a cryptographic signature of data corresponding to the feature vector; and print a barcode on the article with the printer, the barcode including an encoded representation of the data corresponding to the feature vector and the cryptographic signature.

12. The system of claim 11, the processor being further configured to:

print the bar code with the printer on an area of the article outside of the region of interest.

13. The system of claim 11, the processor being further configured to:

print at least one registration mark on the article with the printer to identify the region of interest.

14. The system of claim 11, the processor being further configured to:

generate error correction code (ECC) data corresponding to the feature vector;

generate a hash of the feature vector;

generate the cryptographic signature of data corresponding to the ECC data and the hash of the feature vector; and print the bar code on the article with the printer including the encoded representation of the ECC data, the hash of the feature vector, and the cryptographic signature.

15. The system of claim 11, the processor being further configured to:

generate the cryptographic signature with reference to a predetermined private key.

16. The system of claim 11 wherein the article is a sheet of paper.

17. The system of claim 11 wherein the external illumination source is a non-coherent light source.

* * * * *